United States Patent [19]

Sato

[11] 4,214,850

[45] Jul. 29, 1980

[54] VARIABLE-CAPACITY RADIAL TURBINE

[75] Inventor: Shojiro Sato, Yokohama, Japan

[73] Assignee: Ishikawajima-Harima Jukogyo Kabushiki Kaisha, Tokyo, Japan

[21] Appl. No.: 908,707

[22] Filed: May 23, 1978

[30] Foreign Application Priority Data

Oct. 12, 1977 [JP] Japan ..... 52-121488
Apr. 11, 1978 [JP] Japan ..... 53-41736

[51] Int. Cl.[2] ..... F01D 17/08; F01D 17/12
[52] U.S. Cl. ..... 415/49; 415/151
[58] Field of Search ..... 60/600, 602; 415/151, 415/157, 158, 49, 148, 150

[56] References Cited

U.S. PATENT DOCUMENTS 3,975,911 8/1976 Morgulis et al. ..... 415/158
3,994,620 11/1976 Spraker et al. ..... 415/157

FOREIGN PATENT DOCUMENTS 2633587 2/1978 Fed. Rep. of Germany ..... 60/602

*Primary Examiner*—Louis J. Casaregola
*Attorney, Agent, or Firm*—Scrivener, Parker, Scrivener and Clarke

[57] ABSTRACT

A variable-capacity radial turbine is provided with a gas flow rate control plate which may throttle a restriction of a scroll-shaped channel of a turbine casing, through which flows the exhaust gases into a turbine impeller, so that the impeller may rotate substantially at a constant speed and consequently the intake pressure may be maintained constant over a predetermined engine speed range.

4 Claims, 9 Drawing Figures

VARIABLE-CAPACITY RADIAL TURBINE

DETAILED DESCRIPTION OF THE INVENTION

The present invention relates to a variable capacity radial turbine particularly adapted for use as an engine exhaust turbine of a small-sized supercharger for a vehicle.

The small-sized superchargers are used to increase the power output from automotive diesel or gasoline engines. For marine duty diesel engines and the stationary diesel engines for generating the electric power, the conventional gas turbines are used which are powered from the engine exhaust, and it is in general not necessary to control the supercharged intake air pressure because high torque is not required at medium and low speeds and a required power output can be easily obtained at a rated operating point. However in case of the automotive diesel engines, the rotational speed and power output must be varied over a wide range and high torque is required at medium and low speeds so that the intake air must be supercharged to a high pressure, whereby a sufficient amount of intake air may be charged into the cylinders to burn more fuel. However, when a supercharger which may increase the intake air pressure at medium and low speeds is used, it delivers excessively supercharged air at high speeds so that the undesirable severe load is placed on the engine due to the increase in explosion pressure. Therefore there must be provided means for controlling the intake air pressure supercharged in case of the automotive diesel engines.

For the gasoline engines, the air-to-fuel ratio must be more severely controlled than for the diesel engines so that the intake air pressure must be more severely controlled.

In order to control the intake air pressure discharged from a supercharger, various methods and systems have been devised and demonstrated as will be described below.

(1) A system wherein a relative small-capacity supercharger especially designed for the optimum operation at medium and low speeds is used. That is, the intake air pressure is increased as high as possible at medium and low speeds. However, the intake air pressure becomes inevitably excessively high as described above at high speeds so that the required characteristic cannot be obtained. However this supercharger system is simplest in construction and most inexpensive in cost, it has been used widely in the general automotive diesel engines and the diesel engines for construction machinery with or without a fuel flow rate control system.

(2) A bypassing system wherein a carburetor induction pipe is provided with an automatically-controlled air vent valve so that when the intake air pressure exceeds a predetermined level, the air vent valve is opened. Since this system controls the intake air which is relatively low in temperature, it is simple in construction as compared with an exhaust gas bypassing system to be described hereinafter. However, because of the air vent valve, the supercharger cannot be satisfactorily made compact in size and is expensive to manufacture.

(3) An exhaust gas bypassing system wherein an engine exhaust pipe is provided with an automatically-controlled bypassing valve so that when the intake air pressure exceeds a predetermined level the bypassing valve is opened so as to bypass part of the exhaust gases from the engine to a turbine exhaust pipe. This system must control the high temperature exhaust gases so that it becomes complex in construction and expensive to manufacture.

(4) A variable turbine nozzle system wherein when the intake air pressure exceeds a predetermined level, a nozzle is automatically opened so as to control the turbine output. From the standpoint of energy saving and mode of operation, this system is ideal but is extremely expensive to manufacture. As a result, this system has not been used in practice except special cases where high efficiency must be attained at any cost.

FIG. 1 shows the relationship between the rotational speed N (r.p.m.) of an engine on the one hand and the intake air pressure P (mm Hg) and torque T (%) on the other hand. That is, the rotational speed N is plotted along the abscissa while the intake air pressure P and the torque T, along the ordinate. In case of a diesel engine with a turbo type supercharger, the intake pressure p changes with rotational speed N as indicated by the curve a. With a small-capacity turbine, the overall intake air pressure rises as indicated by the curve b. In order to attain the desired torque characteristic, the intake air pressure must be maintained substantially constant from 1,400 to 2,300 r.p.m. (the maximum rotational speed) as indicated by the curve c. With the small capacity turbine, the sufficient intake air pressure (that is the sufficient amount of intake air) may be ensured up to 1,400 r.p.m. as indicated by the curve b so that the required torque may be produced. However, in excess of 1,400 r.p.m., the intake air pressure is too high so that excessive pressure is created in the cylinder, causing damage to the engine. Therefore, as indicated by the curve c, the intake pressure must be maintained substantially constant in a predetermined speed range.

Accordingly, the present invention has for its object to provide a variable capacity radial turbine for use in a supercharger which may maintain the intake air pressure substantially constant in a predetermined speed range of an engine as indicated by the curve c in FIG. 1.

The above and other objects, features and advantages of the present invention will become more apparent from the following description of some preferred embodiments thereof taken in conjunction with the accompanying drawings, in which.

Figure 2:
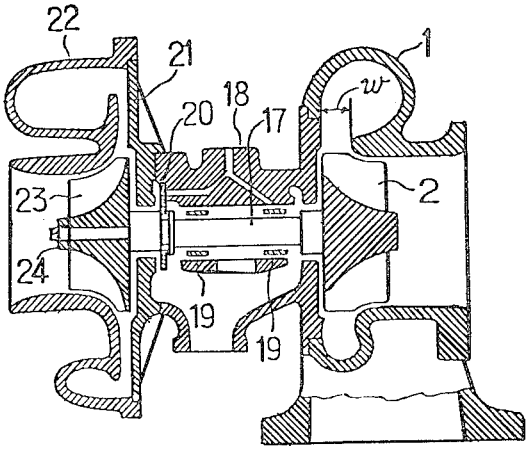
FIG. 2 PRIOR ART
FIG. 2 is a sectional view of a small-sized supercharger.

Referring to FIG. 2, a turbine impeller 2 is journalled in a turbine impeller chamber or casing 1 and is driven by the exhaust gases flowing through a scroll-shaped channel or passage and a restriction opening w. The turbine impeller 2 is securely joined by welding to one end of a combined turbine and blower shaft 17, and a blower wheel 23 is securely attached to the other end of the common shaft 17 with a nut 24. The shaft 17 is rotatably journalled through bearing metals 19 in a bearing wheel chamber or casing 18 with a thrust bearing metal 20. The blower wheel 23 is enclosed in a blower chamber or casing 22 with an end plate or a partition plate 21.

First Embodiment, FIGS. 3, 4, 5 and 6

Figure 3:
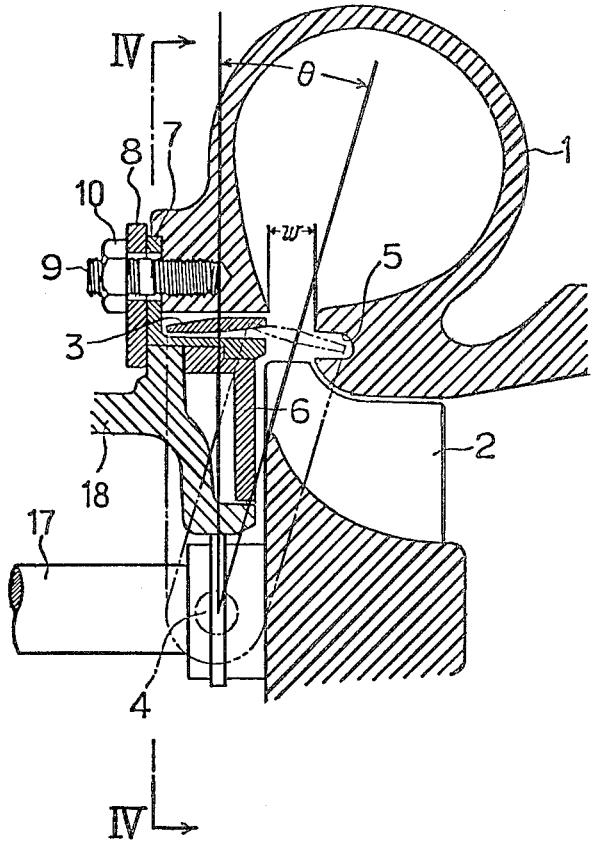
FIG. 3 is a fragmentary sectional view, on enlarged scale, of a first embodiment of the present invention.

Referring to FIG. 3 which is a fragmentary sectional view, on enlarged scale, of the turbine shown in FIG. 2, a semi-circular gas flow rate control plate 3 is so disposed as to selectively close the restriction w through which flows the exhaust gases into the turbine impeller 2. 4 is a shaft for rotating the flow rate control plate 3 in the directions in parallel with the axis of the combined turbine and blower shaft 17 and is located substantially perpendicular to the shaft 17. 5 is a groove formed in the turbine casing 1 for receiving therein the flow rate control plate 3 when the latter is closing the restriction w. 6 is a heat shielding plate. 7 is a spacer ring and 8 is a retaining ring. 9 is a bolt and 10 is a nut. They interconnect between the bearing wheel chamber 18 and the turbine chamber 1.

Figure 4:
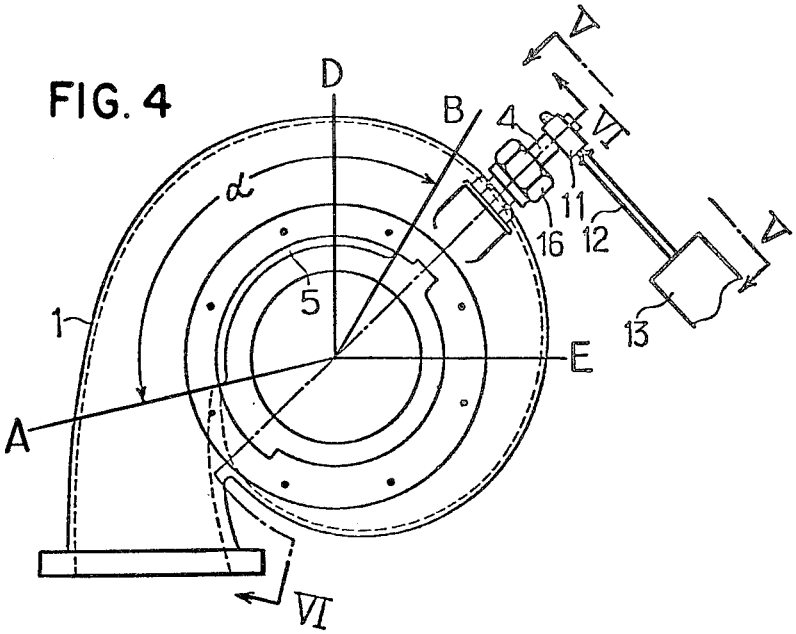
FIG. 4 is a view looking in the direction indicated by arrows IV of FIG. 3, a turbine impeller, a gas flow rate control plate, a heat shielding plate, a spacer ring, a pressure ring and bolts and nuts being removed.
Figure 5:
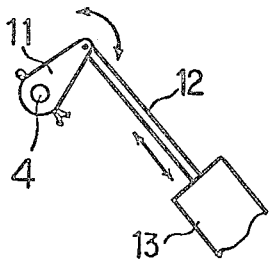
FIG. 5 is a view looking in the direction indicated by arrows V of FIG. 4.

FIG. 4 is a view looking in the direction indicated by the arrows IV of FIG. 3. The turbine impeller 2, the gas flow rate control plate 3, the heat shielding plate, the spacer ring 7, the retaining ring 8, the bolt 9 and the nut 10 are removed. 11 is a lever for rotating the flow rate regulating plate shaft 4, and 12 is a piston rod for swinging the lever 11. 13 is a cylinder for swinging the lever 11 through the rod 12 in response to the intake air pressure so that the desired intake air pressure characteristic may be obtained as indicated by the curve c in FIG. 1. In response to the signal representative of the intake air pressure, the cylinder 13 is actuated. The connection between the lever 11, the piston rod 12 and the cylinder 13 is shown in FIG. 5.

Figure 6:
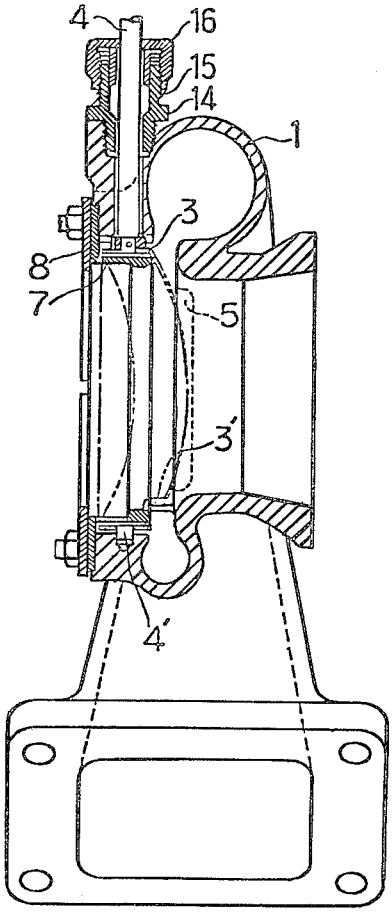
FIG. 6 is a view looking in the direction indicated by arrows VI of FIG. 4, the gas flow rate control plate being mounted.

FIG. 6 is a view taken along the line VI—VI of FIG. 4, and 3' is a notch formed in the gas flow rate control plate 3. 4' is a pin welded to the gas flow rate control plate 3 at the end opposite to the shaft 4. Therefore the gas flow rate control plate 3 may be rotated smoothly about the shaft 4 and the pin 4'. 14 is a gas seal main body; 15 is a packing; and 16 is a cap nut.

The main feature of the first embodiment shown in FIGS. 3–6 is that the gas flow rate control plate 3 is provided which is rotatable through an angle $\theta$ (See FIG. 3) about the shaft 4 which is perpendicular to the shaft 17. The flow rate control plate 3 is so dimensioned and contoured (arcuate) that it may obturate the restriction w through a suitable angle $\alpha$ (A to B in FIG. 4) along the scroll-shaped channel, A being the angular position of the end of the scroll-shaped channel. However, the restriction extended through the remaining angle B-E-A ($360° - \alpha°$) is normally maintained opened.

The obturation angle $\alpha$ varies with the angle $\theta$ of rotation of the shaft 4. The angle of rotation of the shaft 4 is in turn controlled by the power cylinder 13 in response to the intake air pressure, the rotational speed of the engine or the pressure at the inlet to the turbine in such a way that the desired intake air pressure characteristic may be attained as described above.

Next the mode of operation of the first embodiment will be described in detail hereinafter. The intake air pressure is selected as for instance 700 mm HG at the maximum rotational speed for instance 2,300 r.p.m. (See FIG. 1). This value is selected so that the optimum combustion may be ensured without creating excessive pressure in the cylinder, and the supercharger is designed accordingly.

Figure 1:
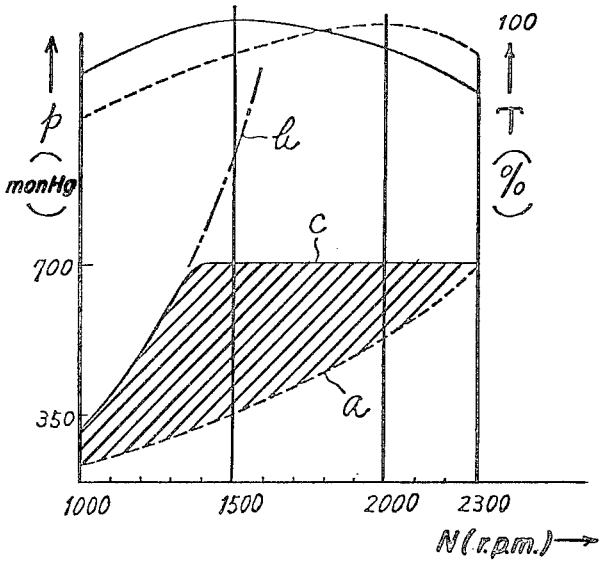
FIG. 1 is a graph illustrating the relationship between the rotational speed of an engine on the one hand and the intake air pressure and the torque on the other hand as described above.

When the rotational speed N is gradually decreased from the maximum speed, the intake pressure delivered from the conventional turbosupercharger decreases gradually as indicated by the curve a in FIG. 1, but the supercharger incorporating the turbine in accordance with the present invention may maintain the intake air pressure substantially constant as indicated by the curve c in FIG. 1. That is, in response to the signal representative of the air intake pressure, the power cylinder is actuated to swing the gas flow rate control plate 3 through the piston rod 12, the lever or crank 11 and the shaft 4 in the clockwise direction in FIG. 3 from the inoperative position indicated by the solid lines in FIG. 3. As a result the effective opening area of the restriction w is gradually decreased so that the velocity of the exhaust gases flowing through the restriction w is increased and consequently the energy for driving the turbine impeller 2 is increased. Thus the rotational speed of the turbine remains almost unchanged so that the intake air pressure may be maintained substantially constant as indicated by the curve c in FIG. 1 even when the rotational speed of the engine decreases.

When the rotational speed of the engine drops to a predetermined value (for instance 1,400 r.p.m. in FIG. 1), the flow rate control plate 3 completely closes the restriction w through the angle $\alpha$ (See FIG. 4). As a result, the intake air pressure gradually drops as the rotational speed of the engine drops as indicated by the curve a in FIG. 1.

When it is desired to gradually increase the rotational speed of the engine, the gas flow rate control plate 3 is initially brought to the operative position indicated by the broken lines in FIG. 3. As the engine speed is increased, the intake air pressure p increases as indicated by the curve b in FIG. 1 which shows the engine speed-intake pressure characteristic of the small-sized supercharger as described elsewhere. When the rotational speed of the engine reaches for instance about 1,400 r.p.m., the intake air pressure rises to 700 mm Hg (See FIG. 1). In order to maintain the intake pressure at 700 mm Hg even when the engine speed exceeds 1,400 r.p.m., the opening degree $\theta$ of the gas flow rate control plate 3 is controlled in response to the signal representative of the intake air pressure in a manner substantially similar to that described above.

From FIG. 1 it can be seen that the supercharger incorporating the turbine in accordance with the present invention may charge more air (indicated by the hatched area in FIG. 1) than the conventional turbosupercharger (whose engine speed-intake pressure characteristic is indicated by the curve a). As a result, the required high torque may be obtained at medium and low speeds while maintaining the smoke level at a low value.

Figure 7:
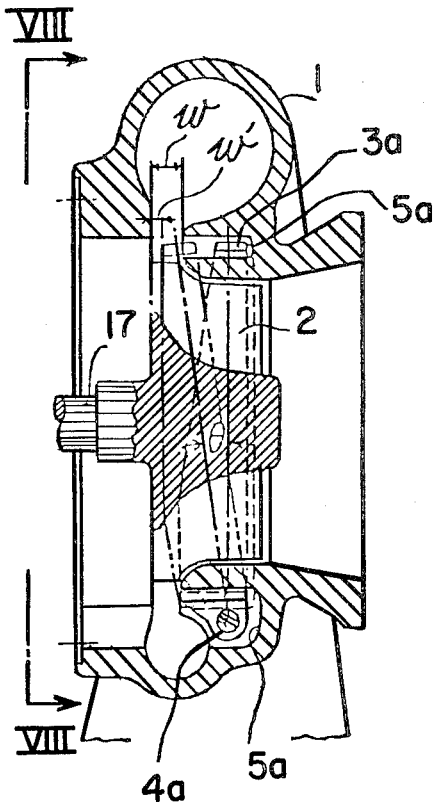
FIG. 7 is a sectional view of a second embodiment of the present invention.
Figure 8:
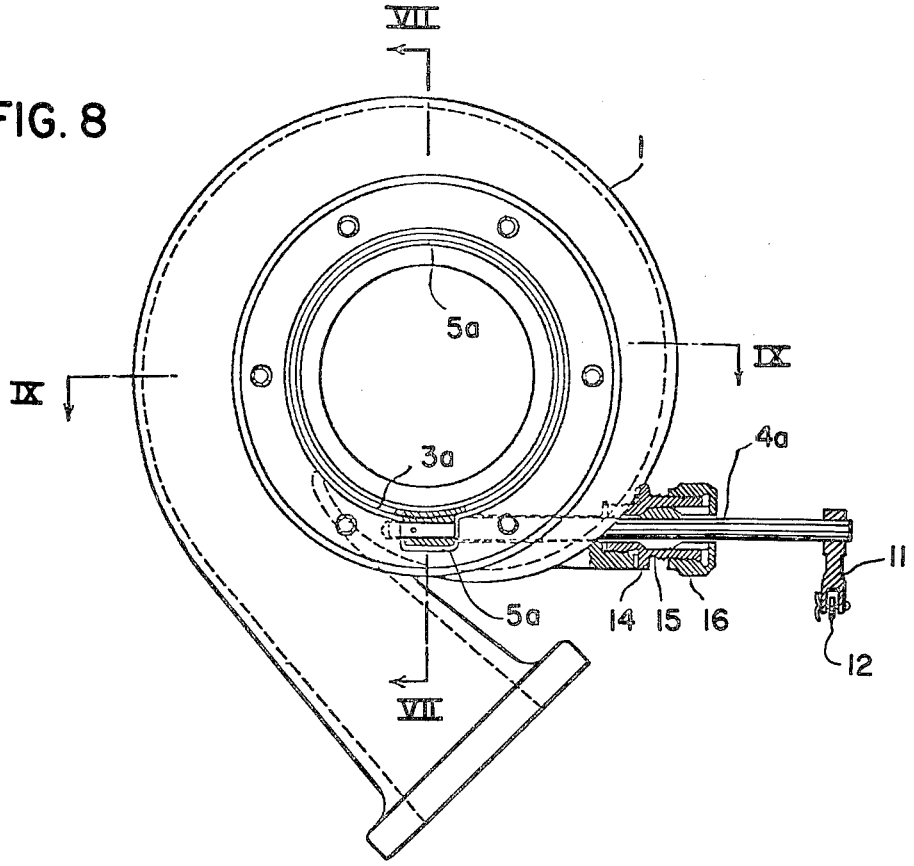
FIG. 8 is a view looking in the direction indicated by arrows VIII of FIG. 7, the turbine impeller being removed.
Figure 9:
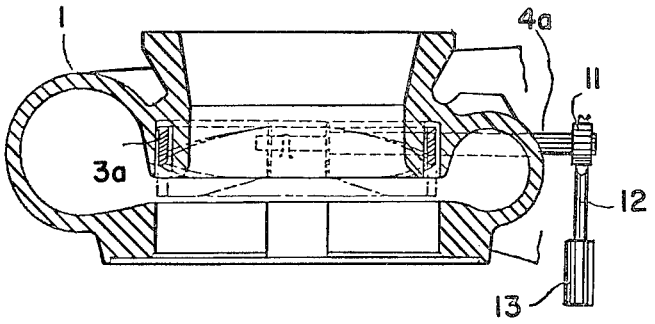
FIG. 9 is a sectional view taken along the line indicated by IX—IX of FIG. 8.

Second Embodiment, FIGS. 7 through 9

The second embodiment shown in FIGS. 7 through 9 is substantially similar in construction to the first embodiment described above with reference to FIGS. 2 through 6 except that a rotary shaft 4a of a gas flow rate control plate 3a is so located that it may be substantially perpendicular to the combined turbine and blower shaft 17 but it may not intersect the axis of the shaft 17 and that the gas flow rate control plate 3a is in the form of a ring. The ring-shaped flow rate control plate 3a is extended out or retracted into an annular or circumferential groove 5a formed in the turbine chamber or casing 1, whereby the opening degree of the restriction w may be controlled.

The gas flow rate control plate 3a is carried by the shaft 4a in such a way that it may swing in parallel with the axis of the shaft 17. As in the case of the first embodiment, the shaft 4 is rotatably mounted on the turbine casing 1 through the gas seal 14 and the packing with the cap nut 16 and is operatively coupled through the lever or crank 11 and the piston rod 12 to the power cylinder 13.

The main features of the second embodiment shown in FIGS. 7 through 9 resides in the fact that the gas flow rate control plate 3a, which is carried by the shaft 4a the axis of which is substantially perpendicular to but will not intersect the axis of the shaft 17, is swingable through an angle $\theta$ (See FIG. 7) about the shaft 4 and is so dimensioned and contoured (in the form of a ring) that it may partly or completely close the restriction w through which flows the exhaust gases into the turbine impeller in response to the intake air pressure, the engine speed or the pressure at the inlet to the turbine, whereby the desired engine speed-intake pressure characteristic may be obtained as indicated by the curve c in FIG. 1.

Next the mode of operation will be described. Assume that the optimum intake pressure be for instance 700 mm Hg at the maximum engine speed of for instance 2,300 r.p.m. (See FIG. 1). This value is selected so that the optimum combustion may be maintained without creating excessively high pressure in the cylinder. The supercharger is designed based on this value.

When the engine speed is gradually decreased from the maximum speed, the intake air pressure delivered from the conventional turbosupercharger drops gradually as indicated by the characteristic curve a in FIG. 1. However, the intake pressure delivered by the supercharger incorporating the turbine of the present invention may be maintained substantially constant until the engine speed drops to a predetermined speed as indicated by the characteristic curve c in FIG. 1. As in the first embodiment, in response to the signal representative of the intake pressure, the power cylinder 13 is actuated to swing the flow rate control plate 3 through the rod 13, the lever or crank 11 and the shaft 4a in the counterclockwise direction from the retracted or inoperative position indicated by the solid lines in FIG. 7 through an angle $\theta$, whereby the restriction w may be throttled as indicated by w'. As a consequence, the velocity of the exhaust gases passing through the throttled restriction w' is increased and consequently the energy for driving the turbine impeller is increased. Therefore the impeller is driven at a constant speed so that even when the engine speed drops, the intake air pressure remains almost unchanged as indicated by the characteristic curve c in FIG. 1.

When the engine speed drops to a predetermined speed, for instance 1,400 r.p.m. in FIG. 1, the gas flow rate control plate or ring 3a is fully extended out of the annular or circumferential groove 5a so that as the engine speed drops the intake air pressure also drops gradually as indicated by the curve c in FIG. 1.

When the engine speed is increased, the gas flow rate control plate or ring 3a is initially brought into the inoperative or retracted position. As the engine speed is increased, the intake air pressure may be increased gradually and maintained substantially constant as indicated by the curve c in FIG. 1 as in the case of the first embodiment.

In summary, the effects and advantages of the variable capacity radial turbine in accordance with the present invention may be summarized as follows:

(i) The radial turbine in accordance with the present invention is very simple in construction and yet is so reliable and dependable in operation that when combined with a blower or a compressor of a supercharger for an automotive diesel engine high torque may be always ensured at medium or low speeds.

(ii) The manufacturing of the radial turbine in accordance with the invention is very easy because the construction can be attained by the improvement of the supercharger only.

(iii) The turbine of the present invention may be easily incorporated into the existing supercharger system without any modification because the turbine is substantially similar in dimension and contour to the conventional turbine used in the system.

(iv) The support of the gas flow rate control plate can be securely attained because the control plate is in the form of a bow and the both ends thereof are supported in such a way that the control plate may be smoothly swung about the supported points.

(v) The ring-shaped gas flow rate control plate is supported at one point for swinging movement about the axis thereof so that the exhaust gases may be smoothly redirected toward the turbine impeller without a minimum loss in kinetic energy, whereby the intake air pressure may be maintained substantially constant in a stable and dependable manner within the desired engine speed range.

What is claimed is:

1. Variable capacity radial turbine apparatus for driving a rotary blower or the like, comprising (a) a hollow casing containing
  (1) a central chamber having an axially arranged outlet;
  (2) a generally helical scroll-shaped chamber arranged concentrically about said central chamber, said scroll-shaped chamber having a tangentially arranged inlet; and
  (3) means defining an opening between said chambers, whereby pressure fluid from said scroll-shaped chamber may be introduced into said central chamber for driving an impeller arranged therein;

(b) control means pivotally connected with said casing for pivotal movement about an axis normal to the longitudinal axis of said central chamber for controlling the effective cross-sectional area of said opening; and (c) pressure-responsive piston-motor means for adjusting the position of said control means to throttle said opening, whereby the size of said opening may be regulated as a function of the inlet pressure of said turbine.

2. Variable capacity radial turbine apparatus as defined in claim 1, wherein said control means comprises a generally arcuate plate member to throttle said opening extending through a given angle relative to the end of said scroll-shaped chamber.

3. Variable capacity radial turbine apparatus as defined in claim 1, wherein said control means comprises a ring member concentrically arranged relative to the longitudinal axis of said central chamber, said ring having a substantially similar configuration as said scroll-shaped chamber.

4. Variable capacity radial turbine apparatus as defined in claim 1, wherein the side wall of said casing contains a groove for receiving said control means when said control means at least partially closes said opening.

* * * * *